US008414188B2

(12) United States Patent
Koesters

(10) Patent No.: US 8,414,188 B2
(45) Date of Patent: Apr. 9, 2013

(54) STAND-UP FILM BAG AND METHOD OF MAKING SAME

(75) Inventor: Jens Koesters, Wallenhorst (DE)

(73) Assignee: Nordenia Deutschland Halle GmbH, Halle (DE)

( * ) Notice: Subject to any disclaimer, the term of this patent is extended or adjusted under 35 U.S.C. 154(b) by 310 days.

(21) Appl. No.: 12/887,130

(22) Filed: Sep. 21, 2010

(65) Prior Publication Data

US 2011/0229060 A1 Sep. 22, 2011

(30) Foreign Application Priority Data

Sep. 25, 2009 (EP) ..... 09012196

(51) Int. Cl.

| | |
|---|---|
| ***B65D 33/06*** | (2006.01) |
| ***B65D 33/16*** | (2006.01) |
| ***B65D 30/16*** | (2006.01) |
| ***B65D 30/20*** | (2006.01) |

(52) U.S. Cl. ..... 383/26; 383/64; 383/80; 383/104; 383/120; 383/906

(58) Field of Classification Search ..... 383/16, 383/21, 25, 26, 104, 120, 63, 64, 80, 107, 383/119, 906

See application file for complete search history.

(56) References Cited

U.S. PATENT DOCUMENTS

| | | | | |
|---|---|---|---|---|
| 3,935,993 | A * | 2/1976 | Doyen et al. | 383/94 |
| 4,905,888 | A * | 3/1990 | Suoss et al. | 229/117.22 |
| 6,213,641 | B1 * | 4/2001 | Price | 383/63 |
| 6,361,209 | B1 * | 3/2002 | LaRue et al. | 383/10 |
| 6,416,221 | B2 * | 7/2002 | Price | 383/63 |
| 6,659,645 | B1 | 12/2003 | Schulz | |
| 6,796,712 | B1 | 9/2004 | Achhammer | |
| 7,182,512 | B2 * | 2/2007 | Bois Henri | 383/5 |
| 7,270,480 | B2 * | 9/2007 | Price | 383/120 |
| 7,396,163 | B2 * | 7/2008 | McGregor | 383/204 |
| 7,670,050 | B2 * | 3/2010 | Haimerl et al. | 383/28 |
| 7,971,720 | B2 * | 7/2011 | Minkler | 206/554 |
| 8,267,579 | B2 * | 9/2012 | Kruse et al. | 383/26 |
| 2008/0080794 | A1 | 4/2008 | Kruse | |
| 2011/0280501 | A1 * | 11/2011 | Brauer et al. | 383/26 |
| 2011/0286688 | A1 * | 11/2011 | Gum et al. | 383/64 |

FOREIGN PATENT DOCUMENTS

| | | | | |
|---|---|---|---|---|
| DE | 3119179 | A | | 12/1982 |
| DE | 3925379 | A | | 1/1991 |
| DE | 3925981 | A1 | | 2/1991 |
| JP | 2000153851 | A | * | 6/2000 |
| JP | 2000153852 | A | * | 6/2000 |
| JP | 2001213443 | A | * | 8/2001 |
| JP | 2005088927 | A | * | 4/2005 |
| JP | 2005231677 | A | * | 9/2005 |

* cited by examiner

*Primary Examiner* — Jes F Pascua
(74) *Attorney, Agent, or Firm* — Andrew Wilford

(57) ABSTRACT

A stand-up pour bag has front and back panels made of a thermoplastic film and having joined longitudinal edges and upper and lower transverse edges bridging the transverse edges. An inwardly folded lower end panel made of thermoplastic film extends between and is joined to the lower edges of the front and back panels, and an inwardly folded upper end panel made of thermoplastic film extends between and is secured at joints to the upper edges of the front and back panels. A closable pourer is bonded to the upper end panel and the upper edge of the front panel at the joint between the upper end panel and the upper edge of the front panel. A carry handle made of a thermoplastic film is bonded to the back panel generally centrally and inward of the edges thereof.

10 Claims, 8 Drawing Sheets

STAND-UP FILM BAG AND METHOD OF MAKING SAME

FIELD OF THE INVENTION

The present invention relates to a stand-up film bag. More particularly this invention concerns such a bag and a method of making it.

BACKGROUND OF THE INVENTION

A stand-up bag made of a heat-sealable plastic film, in particular for fluent substances, that is liquids or granules, typically has a front panel and a back panel that are joined at their longitudinal edges by welds and an inwardly folded lower end panel and an also inwardly folded upper end panel. The front panel and the upper end panel are joined by a transverse weld. A closure is provided at a joint between the front panel and the upper end panel and is connected in a fluid-tight manner to the adjacent faces of the upper end panel and the front panel. The closure may be designed as a pour spout that is closed for example by a cap. The plastic film may be a multilayer coextruded film or composite film that has a heat-sealable polymer layer forming the inner face of the bag.

Such a stand-up bag is particularly suited for packaging of liquid and viscous products. However, packaging of pourable granular solids is also possible. The possible applications range from the packaging of beverages, liquid concentrates, liquid cleaners, and liquid fertilizers, to viscous personal care products, as well as cereals and rice.

Stand-up bags having the above-described features are known from DE 31 19 179 A1 and U.S. Pat. No. 6,796,712. Compared to blow-molded packaging containers, they are characterized by much lower weight and also have the advantage that the empty containers may be transported in a space-saving manner and, after being emptied, may be refolded and disposed of in a space-saving manner. However, due to their low degree of dimensional stability flexible bags are more difficult to handle when pouring out the contents. It is difficult to hold the bag when the contents is being poured out, since the bag panels are flexible and the shape as well as the volume of the bag constantly change during emptying of the contents. Metered emptying of contents requires some skill. The problems become greater with increasing container size.

OBJECTS OF THE INVENTION

It is therefore an object of the present invention to provide an improved stand-up film bag and method of making same.

Another object is the provision of such an improved stand-up film bag and method of making same that overcomes the above-given disadvantages, in particular that is easy to use and handle.

A further object is to provide a stand-up bag that may be securely gripped during pouring of the contents, and that allows metered dispensing of fluids, in particular liquids.

SUMMARY OF THE INVENTION

A stand-up pour bag has according to the invention front and back panels made of a thermoplastic film and having joined longitudinal edges and upper and lower transverse edges bridging the transverse edges. An inwardly folded lower end panel made of thermoplastic film extends between and is joined to the lower edges of the front and back panels, and an inwardly folded upper end panel made of thermoplastic film extends between and is secured at joints to the upper edges of the front and back panels. A closable pourer is bonded to the upper end panel and the upper edge of the front panel at the joint between the upper end panel and the upper edge of the front panel. A carry handle made of a thermoplastic film is bonded to the back panel generally centrally and inward of the edges thereof.

As a result of providing the handle on the lower end panel or the back panel of the stand-up bag according to the invention, during pouring of the contents the package is always held in such a way that the closure necessarily lies at the lowest point. This allows metered dispensing of contents and problem-free emptying of all the contents. The volume and shape of the package change during the pouring operation. However, the stand-up bag according to the invention may always be held securely with one hand, and oriented in such a way that the contents, in particular a liquid or fluent particles contained in the stand-up bag, flow to the closure. The handle is preferably provided approximately at the center of the back panel. The handle may be a strap that is oriented either parallel or transverse to the longitudinal edges. The handle is preferably inward of an outer periphery of the stand-up bag, and therefore does not interfere with the flattened and initially unfilled bag during transport. The handle according to the invention also allows the package to be refolded and disposed of in a space-saving manner after it has been completely emptied.

There are several possibilities for designing the handle. The selection depends on requirements and on the size of the stand-up bag and the weight for which it is designed. A first embodiment provides that the handle is fastened to an inner face of the back panel of the bag, and is accessible through a handle opening in the back panel. Fastening is preferably carried out by heat sealing. The handle opening is closed in a fluid-tight manner by a film sheet that is bonded at the back of the handle to an inner face of the bag by a weld that extends around the handle opening. The handle opening is preferably closed by a detachable film patch of the back panel, so that the handle is provided completely within an outer periphery of the stand-up bag. The stand-up bags, which leave a bag-making plant initially in the form of flattened, unfilled bags, have smooth surfaces and may therefore be easily stacked and transported. In addition, the transport of filled stand-up bags, for example in cartons or other packages, is not adversely affected because the handle is concealed behind a smooth outer surface of the bag.

The following design is advantageous when the handle must be designed for demanding requirements. In this case the handle is a loop-forming strap comprised of a strip of film that reaches around a support sheet. The support sheet, which projects beyond the strap on both sides, is preferably fastened to the back side of the film sheet and/or to an inner face of the bag by welds. The described carry handle design has the advantage that the force that acts while the stand-up bag is carried is initially distributed over the support sheet, and thus over a large surface. Uniform distribution of force allows large loads to be transmitted. For smaller stand-up bags that are designed for a lower filling weight, the handle may also be designed as a simple strip of film. For fastening a simpler handle of this type, it is enough to thermally bond the ends to a film sheet through openings in the bag envelope, the film sheet being fastened by welds to an inner face of the bag, and the openings being closed in a fluid-tight manner. According to another possible design of the handle, a reinforcing sheet is provided at an inner face of the bag and is joined to an inner face by heat sealing, thus forming a strap handle comprised of a section of the bag film bordered by two slots at the edge, and the reinforcing sheet. A closing sheet is also provided that covers an opening formed by the strap handle at the inner face of the bag. To achieve higher load capacity, the slots defining the strap handle may each be provided between two welds that seal the reinforcing sheet to an inner face of the bag.

The front panel, back panel, lower end panel, and upper end panel may be formed by folding a flat web. The front panel and the upper end panel are joined by a weld that closes the folded web into a tube and forms one edge of the stand-up bag. In addition, the folded edges between the lower end panel and the film surfaces of the front panel and back panel, as well as the folded edges between the upper end panel and the film surfaces of the back panel are advantageously reinforced by so-called blind welds. Diagonal welds are also preferably provided in the corners of the bag, each extending from an edge of the lower end panel or the upper end panel to each of the longitudinal edges of the bag, and each joining the front panel or back panel to an adjacent face of the lower end panel or upper end panel.

The lower end panel and the upper end panel usually have the same dimensions. To improve the pouring characteristics, however, it may be advantageous for the lower end panel to be wider than the upper end panel. This means that in the flattened state the lower end panel forms a deeper fold than does the region of the upper end panel.

Numerous polymers and material combinations are suitable as plastic film for making the stand-up bag. In particular, the stand-up bag may be made of transparent polymers, or may be provided with windows for seeing the fill level. Examples of advantageous material combinations are PET/PE, OPP/PE, PET/OPA/PP, OPP/PP, and PE/PE. In addition, transparent barrier layers using SiOx-coated films or coextruded barrier polymer layers, for example EVOH, may be provided. Also usable as plastic films are composite materials that have one or more layers comprised of biodegradable, renewable raw materials. Cellulose/starch polyester and OPLA/PLA polyester compounds are examples. However, composite materials having a metallic intermediate layer or an intermediate layer comprised of a metallized polymer are also suitable for the stand-up bag according to the invention. PET/Al/PE, PET/Al/PP, and OPP (metallized)/PP are advantageous material combinations.

The thickness of the plastic film depends primarily on the bag size and the filling weight for which the stand-up bag is designed. A stand-up bag for liquids having a filling volume of approximately 2.5 liter may be produced, for example, from a plastic film having a three-layer design, with a PET outer layer 12 μm thick, a PET intermediate layer 12 μm thick, and a polyethylene layer 100 μm thick on the inner face of the bag. Finally, a textile may also be incorporated into the film composite to increase the drop strength. Such a plastic film has a PE/textile/PE film composite, for example.

A stand-up pour bag according to this invention is made by first bonding between longitudinally extending front and back edges of a longitudinally extending strip of thermoplastic film at a uniform longitudinal spacing a succession of longitudinally spaced carry handles with the handles closer to the back edge than to the front edge. Then the strip with the handles is folded along longitudinal fold lines into a back substrip carrying the handles, a front substrip having the front edge, a lower V-shaped fold between the front and back substrips, and an upper V-shaped fold having the back edge and between the back edge and the back substrip. The substrips are vertically juxtaposed and the upper and lower folds are set in between the substrips with the back edge of the upper fold directly juxtaposed with the front edge of the front substrip. Pourers separated by the uniform spacing are then inserted between the back edge and front edge, and the back and front edges are bonded in fluid-tight manner to the pourers. The front and back substrips and upper and lower folds of the folded strip are then welded together at transverse seams between the pourers. Finally, the folded strip is cut across at each of the transverse seams into individual stand-up pour bags.

In particular when pourers are provided as closures, first the side-pleat tube is formed by shaping the film web, and the side-pleat tube is closed at its open longitudinal side by a longitudinal weld that is interrupted at a predetermined spacing, thus providing openings for inserting the closures. Only at this point are the closures inserted into the openings in the longitudinal weld and then joined to the film web in a fluid-tight manner. When pourers are used as closures, in addition the shape of the heat sealing tool must be modified to the shape of the pourer.

According to one alternative embodiment of the method, in particular when the closure has reclosable fastener strips, the closures are placed on the film web before the side-pleat tube is formed. In particular, fasteners in the form of zippers or slide fasteners may initially be placed as a continuous strip on a side edge of the film web, and the closures are then provided by forming the side-pleat tube on the longitudinal side, which must still be closed.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
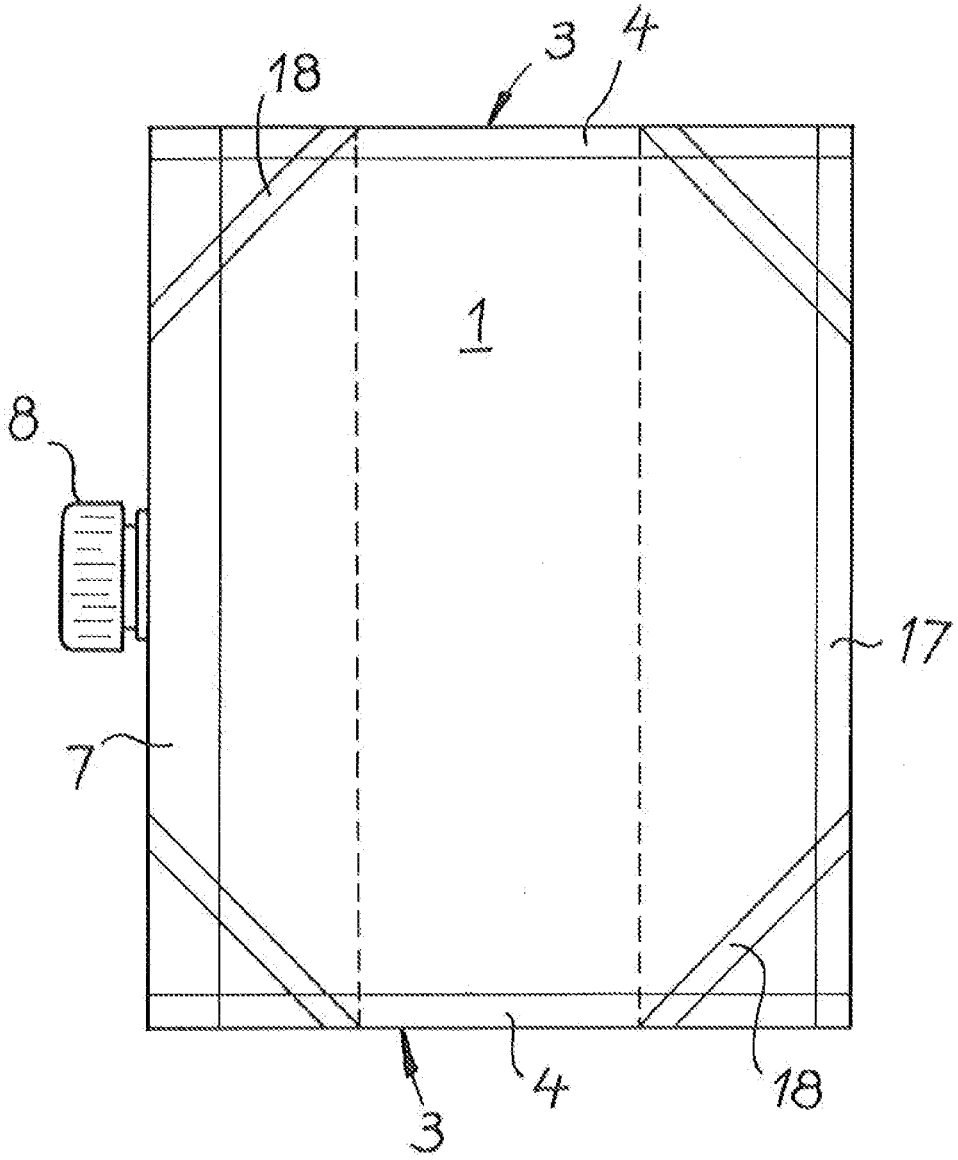
FIG. 1 is a front elevational view of the flattened stand-up bag according to the invention.
Figure 2:
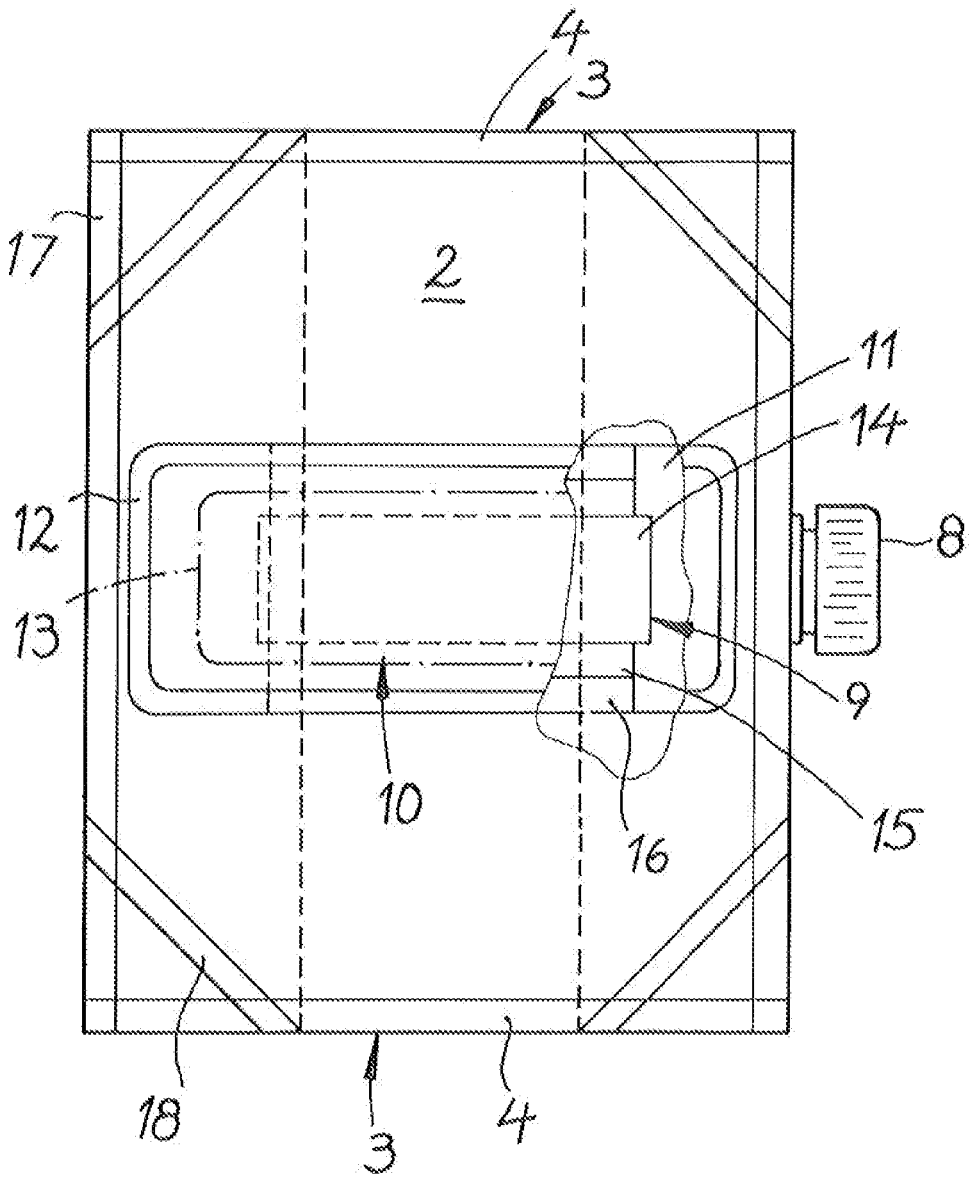
FIG. 2 is a rear elevational view of the flattened stand-up bag.
Figure 3:
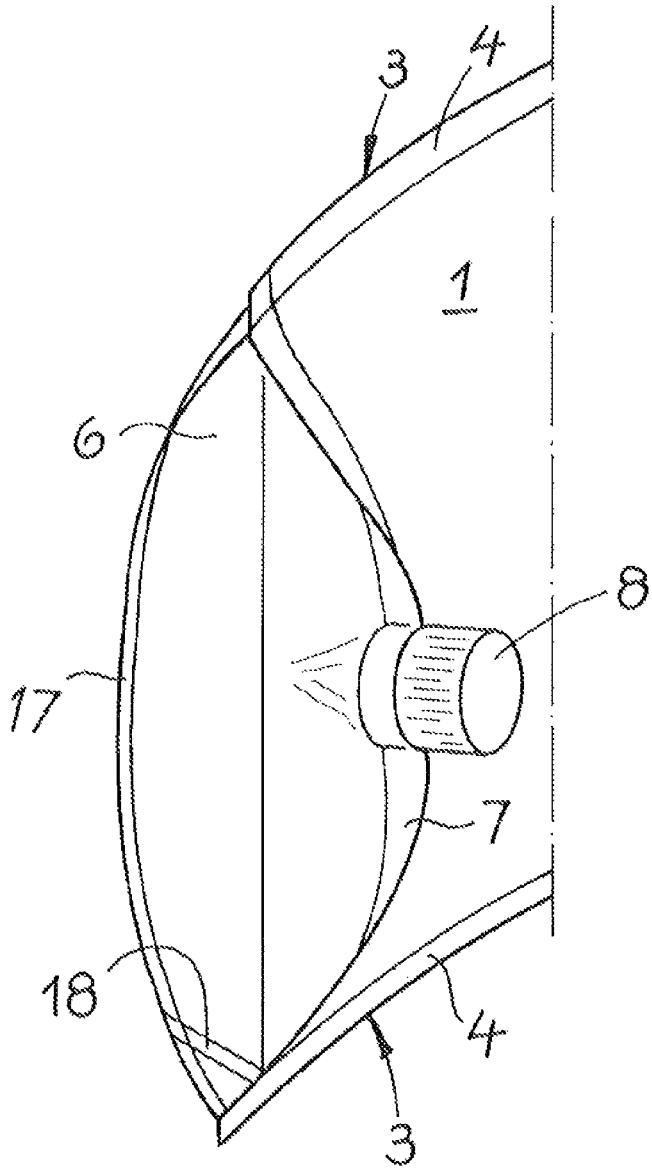
FIG. 3 is a schematic side view of the flattened stand-up bag, spread slightly for purposes of illustration and showing the upper end panel.
Figure 4:
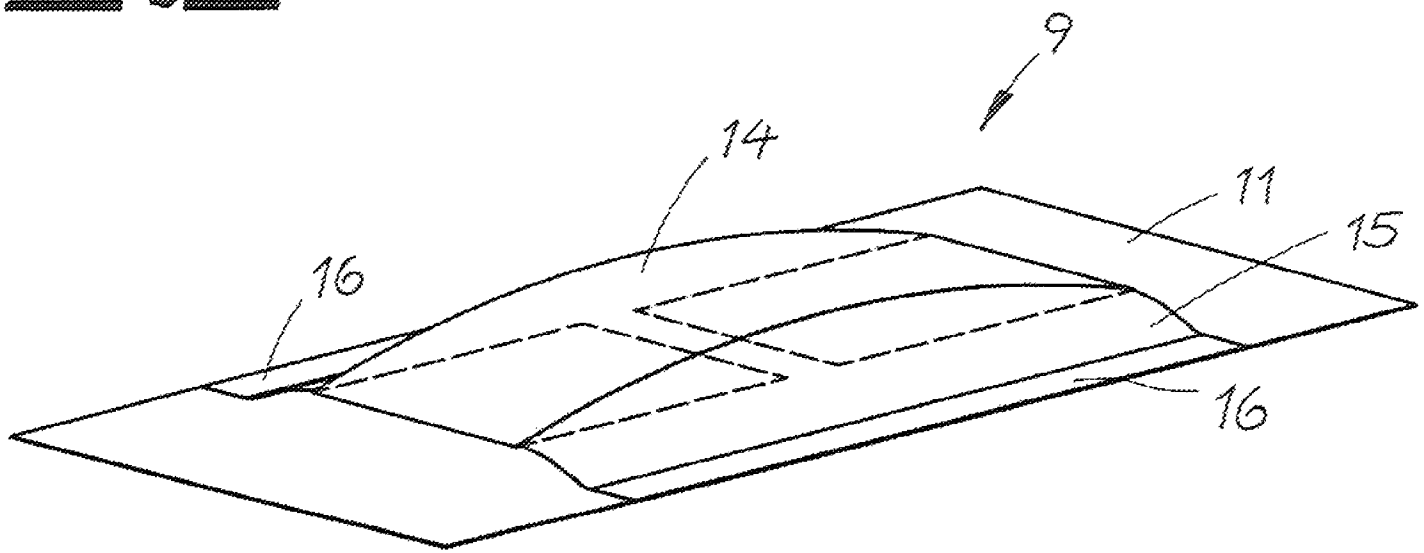
FIG. 4 shows the parts of a handle.

The drawing illustrates a heat-sealable, preferably multilayer, plastic film and is used for packaging fluids, in particular liquids or fluent granules. The stand-up bag is manufactured flat, and is filled with contents in a filling plant. In FIGS. 1-3 the bag is shown on its side.

As shown in FIGS. 1-3 and 5, the stand-up bag according to the invention comprises a front panel 1 and a back panel 2 that are joined at their longitudinal edges 3 by side weld seams 4, and an inwardly folded lower end panel 5 and an also inwardly folded upper end panel 6. The front panel 1 and the upper end panel 6 are joined by a transverse weld seam 7. A pourer 8 provided with a closure is provided at the joint between the front panel 1 and the upper end panel 6, and is connected in a fluid-tight manner to the adjacent edge regions of the upper end panel 6 and the front panel 1.

Figure 5:
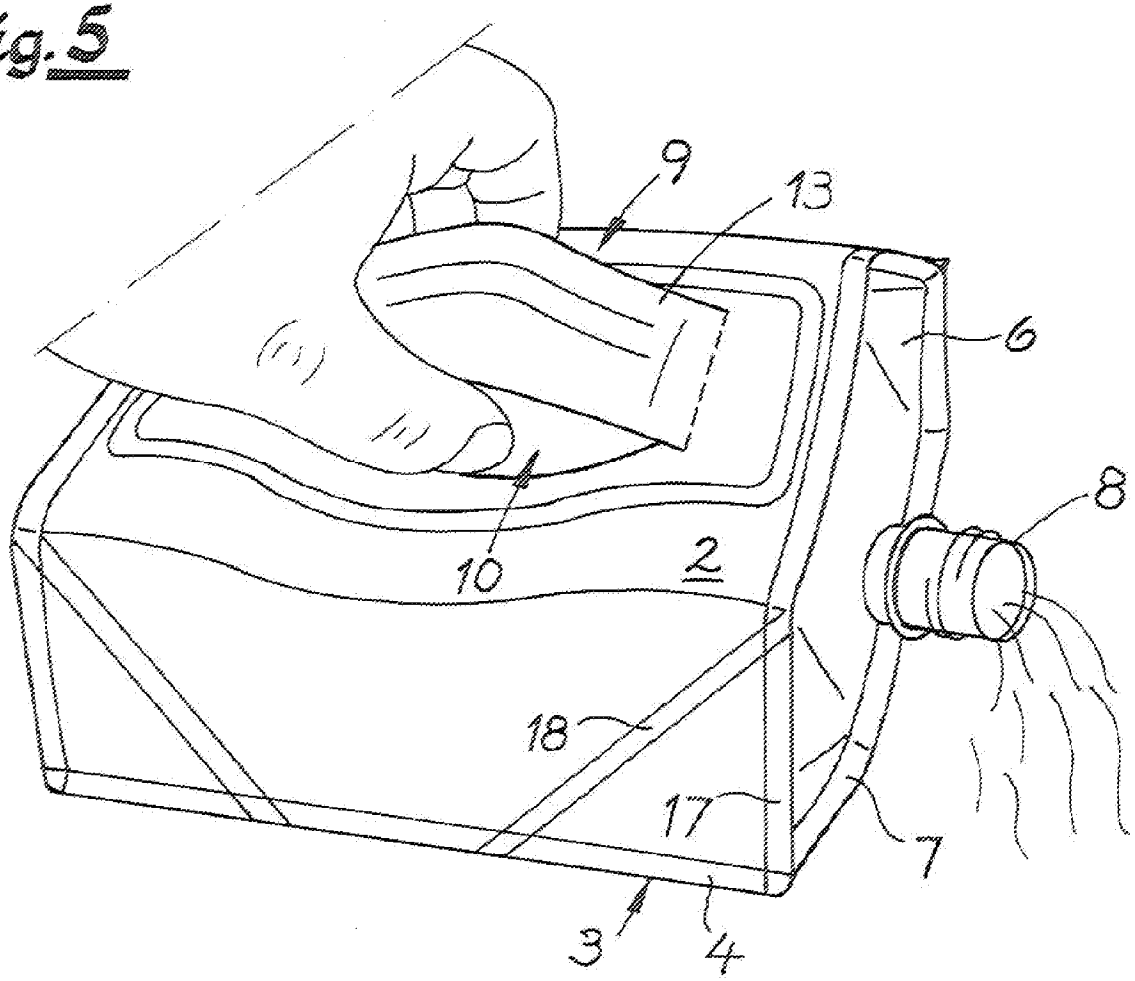
FIG. 5 is a perspective view showing the bag of FIGS. 1-3 in use while pouring.

According to FIG. 2, a film carry handle 9 having the design shown in FIG. 5 is fastened to the back panel 2 of the stand-up bag. The handle 9 lies inward of the outer periphery of the stand-up bag. The film carry handle is fastened to the surface of the back panel 2 on an inner face of the bag, and is accessible through a rectangular handle opening 10 cut into the back panel. The handle opening 10 is closed in a fluid-tight manner by a film sheet 11 that is bonded on its back face to the inner face of the bag at a weld 12 that goes all the way around the handle opening. As shown by FIG. 2, the handle opening 10 may be covered on the outer face of the back panel by a detachable film patch 13.

The drawing of the handle 9 shown in FIG. 5 shows that the handle 9 has a strap 14 comprised of a strip of film whose ends fit under a support sheet 15. The support sheet 15 projects beyond the strap 14 on both sides and is fastened to the back face of the film sheet 11 by welds 16. Additionally or alternatively, the support sheet may be sealed directly to the inner face of the bag.

Figure 6:
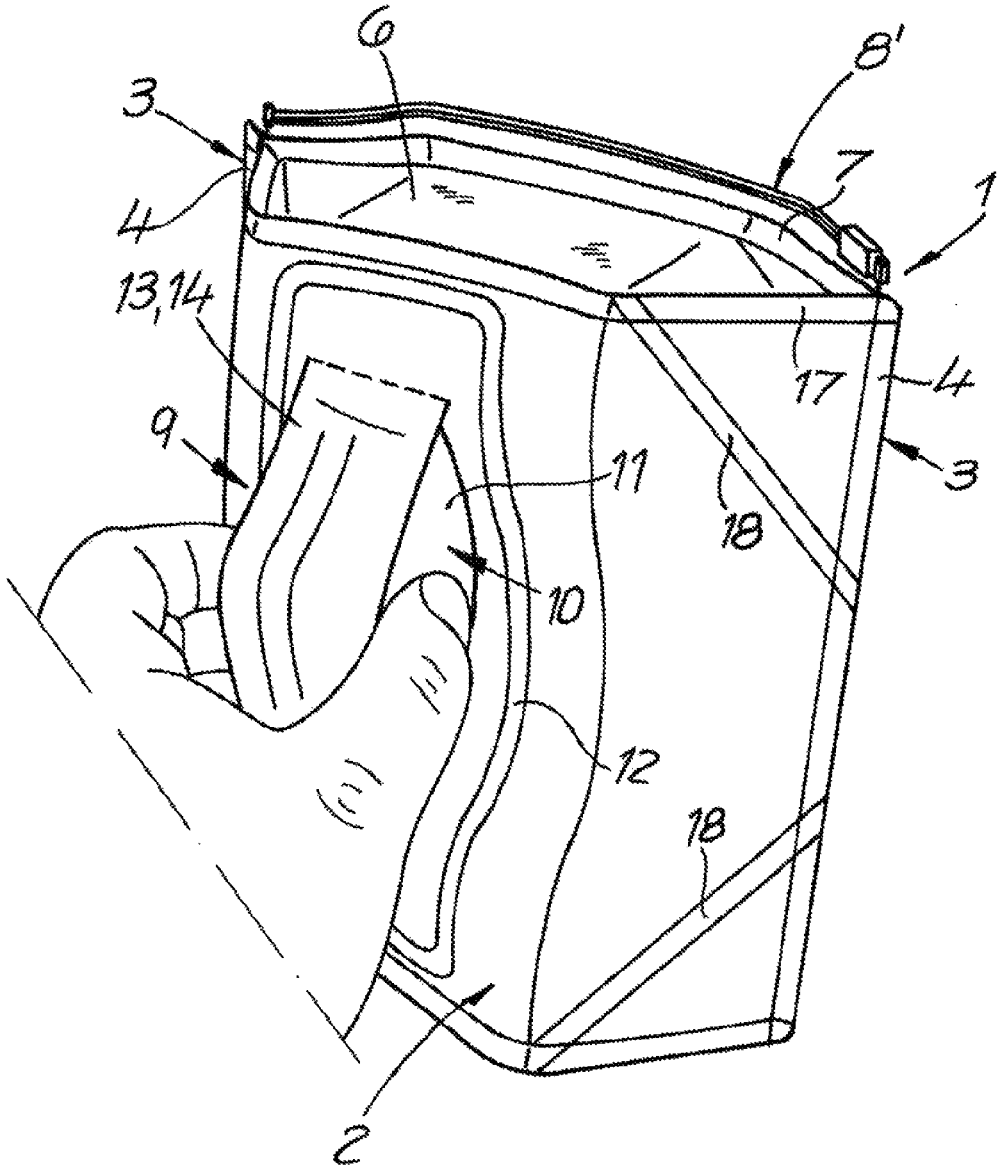
FIG. 6 is a rear perspective view of a variant on the bag according to the invention.

FIG. 6 shows a bag like that of FIGS. 1-5 except that, instead of the pourer 8, the top panel is secured to the front panel 1 by a slide fastener 8' of standard construction, that is having a pair of matable strips and a slider movable thereal-ong. Here there is a handle 9 on the back panel 2, as in FIGS. 1-3 and 5.

The front panel 1, back panel 2, lower end panel 5, and upper end panel 6 are formed by folding from a single flat web. The front panel 1 and an edge of the upper end panel 6 are joined by the weld 7 that closes the folded web into a tube and forms one end of the stand-up bag. In addition, the folded edges between the lower end panel 5 and the film surfaces of the front panel and back panel, as well as the folded edges between the upper end panel 6 and the faces of the front panel and back panel, are reinforced by so-called blind welds 17. The blind welds 17 do not have a sealing function, and are used solely for reinforcing or stiffening the stand-up bag. Diagonal welds 18 are also provided at the corners of the bag that extend from the edges of the lower end panel 5 or the upper end panel 6 to each of the longitudinal edges 3 of the bag. The diagonal welds in each case connect the front panel 1 or back panel 2 to an adjacent flank of the lower end panel 5 or upper end panel 6.

FIG. 5 shows the handling of a stand-up bag according to FIGS. 1-3 as a package for liquids during pouring out of its contents. As a result of providing the film carry handle 9 on the back panel 2 of the stand-up bag, during pouring of the contents the package is always held in such a way that the closure 8 lies at the lowest point, which allows the package to be completely emptied in a problem-free manner. In the illustrated embodiment, the closable pourer 8 is approximately at the center of the edge of upper end panel 6. Off-center configurations are also possible. Likewise, the handle 9 may be oriented parallel or transverse to the longitudinal edges 3.

Figure 7:
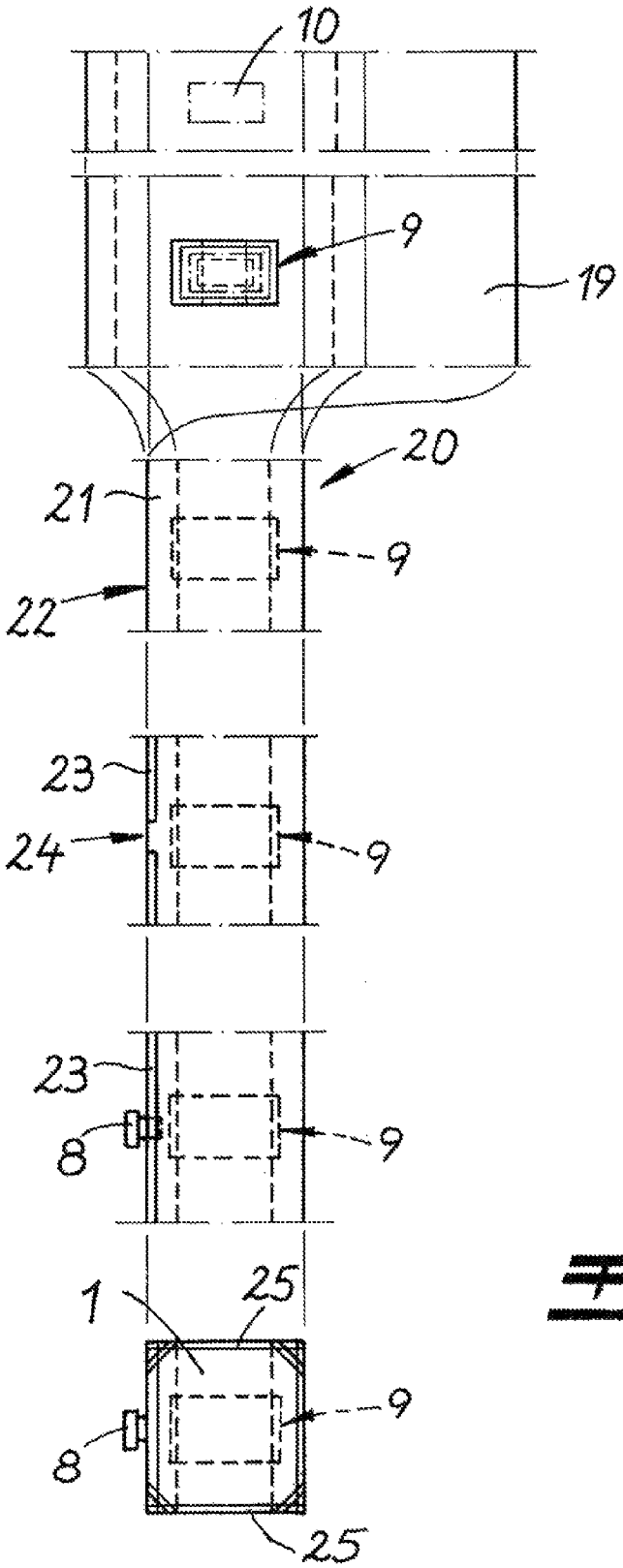
FIG. 7 illustrates the method of making the bag of FIGS. 1-3.
Figure 8:
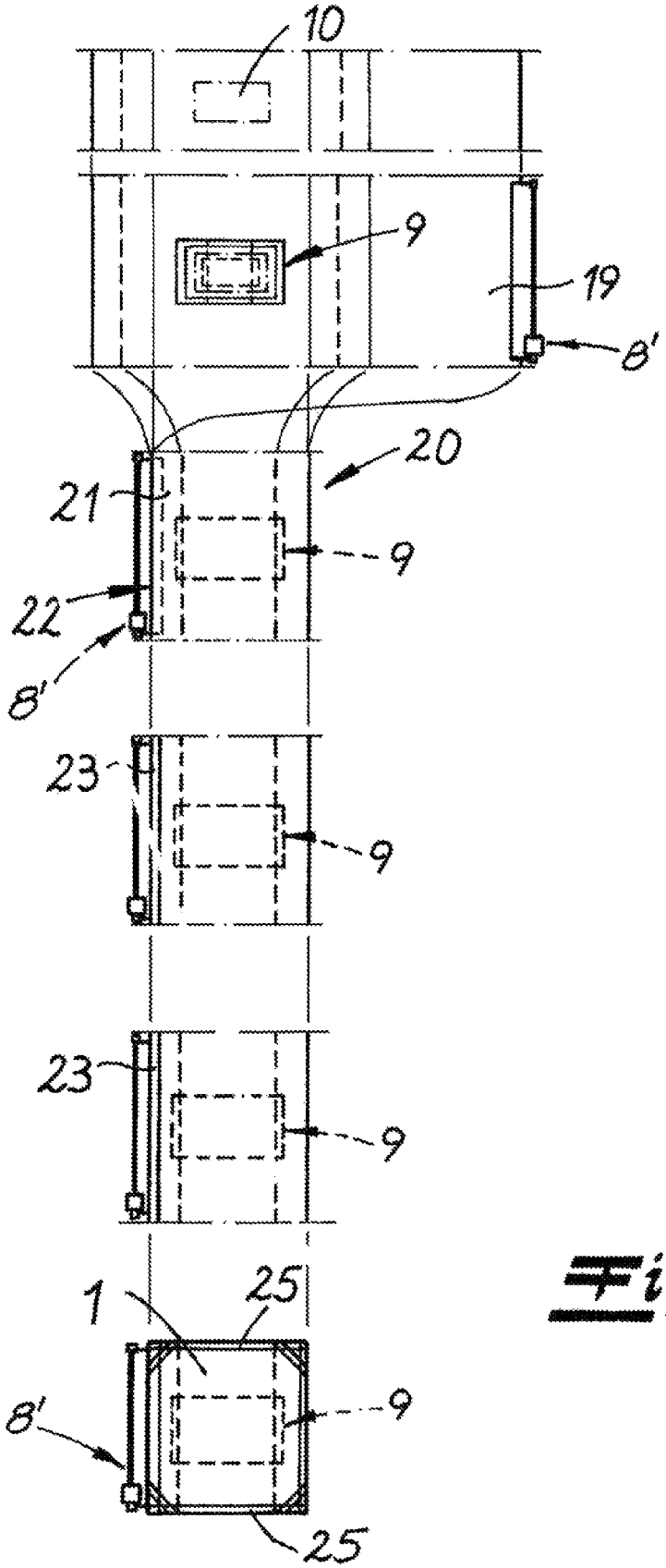
FIG. 8 illustrates the method of making the bag of FIG. 6.

FIGS. 7 and 8 show methods of making the stand-up bag. Handles 9 are first fastened to a flat film web 19 at predetermined spacings in such a way that after the film web 19 is folded over, the handles 9 are positioned at a film face that forms a back panel 2 of the stand-up bag. The handles 9 are prefabricated, and conform for example to the design shown in FIG. 5. The film web 19 is then folded into a flattened side-pleat tube 20 that is still open at one longitudinal side, between a V-shaped inset fold and a surface 21 that forms the front panel 1 of the stand-up bag.

In FIG. 7 the side-pleat tube 20 is closed at its open longitudinal side 22 by a longitudinal weld 23, which in the completed stand-up bag corresponds to the transverse weld 7. The longitudinal weld 23 is interrupted at a predetermined spacing to form openings 24 for insertion of pourers 8. In a further method step, the pourers 8 are inserted into the openings 24 in the longitudinal weld 23 and are joined, typically by welding, to the film web 19 in a fluid-tight manner. Finally, the lower and upper film faces of the flattened side-pleat tube 20 are joined by transverse welds 25. In a final method step, stand-up bags whose longitudinal edges have been formed by the transverse welds 25 are cut from the side-pleat tube 20.

FIG. 8 shows how the seams 23 are made to respective strips of the slide-fastener 8' for a structure as shown in FIG. 6.

The illustration in FIGS. 7 and 8 also shows that handle openings 10 for the film carry handles 9 are provided in the film web 19, and the handles 9 are fastened on the face of the film web 19 that forms the inner face of the bag after the film web 19 is folded

I claim:

1. A stand-up pour bag comprising:

front and back panels made of a thermoplastic film and having joined longitudinal edges and upper and lower transverse edges bridging the transverse edges, the back panel being formed with a throughgoing central hole;

an inwardly folded lower end panel made of thermoplastic film and extending between and joined to the lower edges of the front and back panels;

an inwardly folded upper end panel made of thermoplastic film and extending between and secured at joints to the upper edges of the front and back panels;

a closable pourer bonded to the upper end panel and the upper edge of the front panel at the joint between the upper end panel and the upper edge of the front panel; and a carry handle made of a thermoplastic film, having ends attached to an inner face of the back panel, projecting rearward through the hole, and bonded to the back panel generally centrally and inward of the edges thereof; and a patch engaged with the inner face, overlying the ends, and covering the hole.

2. The stand-up pour bag defined in claim 1 wherein the pourer is a spout and a cap thereon.

3. The stand-up pour bag defined in claim 1 wherein the pourer is a slide fastener.

4. The stand-up pour bag defined in claim 3 wherein the slide fastener extends a full width of the front wall.

5. The stand-up pour bag defined in claim 1 wherein the handle lies within an outer periphery of the back panel.

6. The stand-up pour bag defined in claim 1 wherein the hole is formed by cutting a piece out of the back wall.

7. The stand-up pour bag defined in claim 1 wherein the handle is formed by a strap forming a loop and a support sheet to which ends of the strap are fixed and that projects laterally past the strap, the support sheet being secured by welds to the back panel to each side of the strap and of the hole.

8. The stand-up pour bag defined in claim 1 wherein the edges between the lower end panel and the front panel on one side and the back panel on the other side and between the upper end panel and the back panel are at blind seams.

9. The stand-up pour bag defined in claim 1, further comprising angled seams at each corner of the bag extending diagonally between the front and back seams and the end panels.

10. The stand-up pour bag defined in claim 1 wherein the lower end panel is wider than the upper end panel measured between the front and back panels.

* * * * *